US006170405B1

(12) United States Patent
Weitzman et al.

(10) Patent No.: US 6,170,405 B1
(45) Date of Patent: Jan. 9, 2001

(54) COLLAPSIBLE TABLE

(75) Inventors: Maxim Weitzman, Los Angeles; Ravi K. Sawhney; Hirotomi Teranishi, both of Calabasas; Christopher W. Glupker, Van Nuys; Juan P. Cilia; Kurt G. Botsai, both of Thousand Oaks; Nasahn A. Sheppard, Woodland Hills; John F. Zinni, Capistrano Beach, all of CA (US)

(73) Assignee: Intrigo, Inc., Thousand Oak, CA (US)

( * ) Notice: Under 35 U.S.C. 154(b), the term of this patent shall be extended for 0 days.

(21) Appl. No.: 09/455,327

(22) Filed: Dec. 6, 1999

(51) Int. Cl.[7] ..... A47B 23/00

(52) U.S. Cl. ..... 108/25; 108/43; 108/174; 248/166

(58) Field of Search ..... 108/25, 36, 43, 108/168, 169, 172, 174, 116, 134, 147.22; 248/455, 166

(56) References Cited

U.S. PATENT DOCUMENTS 4,216,951 * 8/1980 Griffin ..... 108/134
4,610,415 * 9/1986 Miller ..... 248/455
5,067,417 * 11/1991 Marmentini et al. ..... 108/36
5,460,102 * 10/1995 Pasmanick ..... 108/43
5,598,786 * 2/1997 Patterson ..... 108/43
5,732,910 * 3/1998 Martin ..... 108/43 X
5,794,540 * 8/1998 Dombrowski et al. ..... 108/172 X

* cited by examiner

*Primary Examiner*—Janet M. Wilkens
*Assistant Examiner*—Michael J. Fisher
(74) *Attorney, Agent, or Firm*—Jack C. Munro

(57) ABSTRACT

A collapsible table which is constructed of a main section which has a substantially planer work surface. The main section is composed of two equally sized parts which are hingedly connected together which permits folding of the main section from a position with the parts in alignment to a position with the parts in juxtaposition. Hingedly connected to each edge of the main section is a leg assembly. Each leg assembly is to be movable, upon actuation of a squeezable handle, from a retracted position alongside of the main section to an extended position substantially transverse to the main section. When in the transverse position, each leg assembly is to be locatable in any one of a plurality of different positions each of which will locate the work surface at a different height from the surface on which the collapsible table is mounted.

5 Claims, 3 Drawing Sheets

COLLAPSIBLE TABLE

BACKGROUND OF THE INVENTION

1) Field of the Invention

The field of this invention relates to a collapsible table and more particularly to a portable table which is designed to be used in conjunction with a lap of a human user and has particular utility to provide a work surface for a laptop computer.

2) Description of the Prior Art

Within recent years, there has been constructed a personal computer known as a laptop computer. This laptop computer is small in size yet can be extremely powerful. Also, a laptop computer can be readily collapsed into a small folding carrying case facilitating transportability on board airplanes and other modes of transportation.

It has become an exceedingly common occurrence that businessmen have in their possession a laptop computer. When using a laptop computer, it has been common to locate such on the lap of the user which creates an uneven and unsteady work surface. It would be desirable to construct some type of a work surface that can be associated in conjunction with the lap of a user which will provide a firm work surface for the support and operation of the laptop computer. However, such a work surface must be adjustable in height in order to accommodate to the different sizes of individuals. Smaller individuals would require that the work surface be located at a lower position while larger individuals would require that the work surface be located at a higher position.

SUMMARY OF THE INVENTION

The collapsible table of the present invention comprises a main section which is composed of two parts which are hingedly connected together. Mounted at each end of the main section is a leg assembly with each of the leg assemblies being essentially identical. Each leg assembly includes a squeezable handle, and upon squeezing of this handle the leg assembly is to be movable from a retracted position abutted against the main section to an extended position located substantially transverse to the main section. When in the transverse position, the leg assembly is to be movable between and fixable within any one of several height positions. When collapsed, the table of this invention can be placed within a carry bag which facilitates portability of the table of this invention.

One of the primary objectives of the present invention is to construct a collapsible table which is to be usable in conjunction with the lap of a human which provides a flat, firm work surface facilitating the support of objects such as a laptop computer.

Another objective of the present invention is to construct a collapsible table which is adjustable to accommodate to different sizes of humans.

Another objective of the present invention is to construct a collapsible table which can be easily and quickly moved from the collapsed position to its operating position not requiring any special skills.

Another objective of the present invention is to construct a collapsible table which may include an article carrying container.

Another objective of the present invention is to construct a collapsible table which may facilitate the connection to exterior structures such as a task light, page holder or cup holder.

Another objective of the present invention is to construct a collapsible table which collapses into a compact capsule that can be stored and transported virtually anywhere.

Another objective of the present invention is to construct a collapsible table which includes resilient soft pads on the work surface to provide a cushioned support of the user's wrists when using of the table.

DETAILED DESCRIPTION OF THE PREFERRED EMBODIMENT

Figure 1:
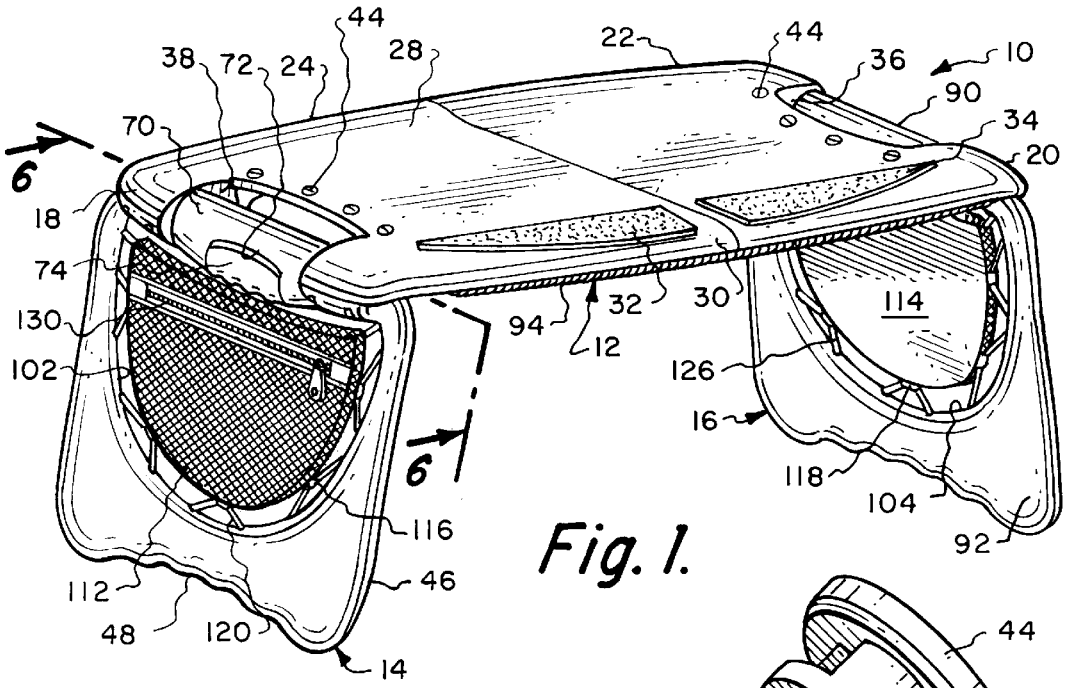
FIG. 1 is a frontal isometric view of the collapsible table of the present invention showing the table in its normal usage position.

Referring particularly to the drawings, there is shown the collapsible table 10 of this invention which generally includes a main section 12 and leg assemblies 14 and 16. Leg assemblies 14 and 16 are basically identical but are just mounted in a reversed relationship relative to each other. The leg assembly 14 is connected to the main section 12 at the left edge 18. The leg assembly 16 is connected to the main section 12 at the right edge 20.

Figures 2, 3, 4:
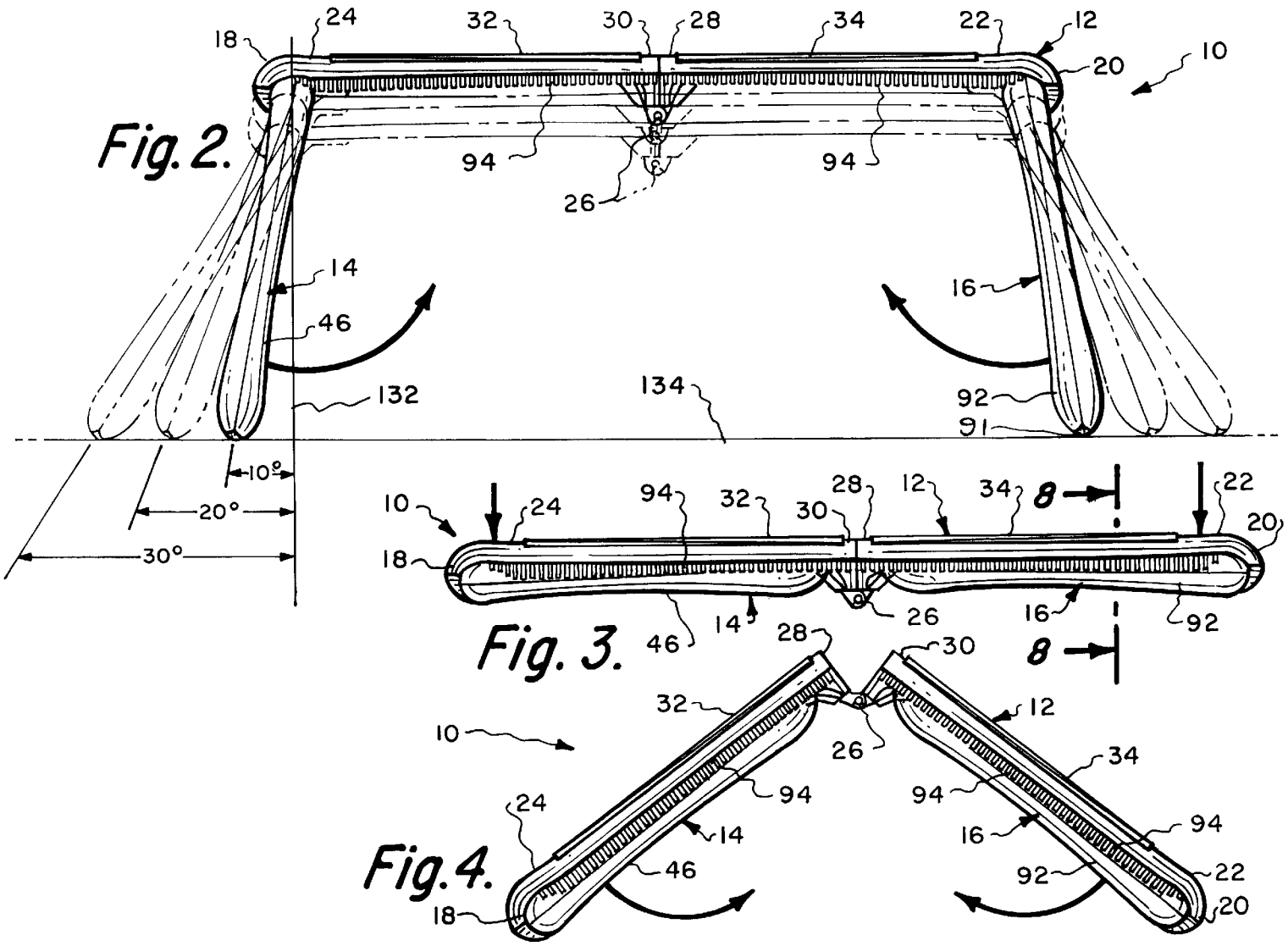
FIG. 2 is a front view of the collapsible table of the present invention showing different height positions of the table.
FIG. 3 is a front view of the collapsible table of the present invention showing the leg assemblies located in the collapsed position relative to the main section of the table.
FIG. 4 is a front view similar to FIG. 3 but showing the main section of the collapsible table being split prior to moving to the completely collapsed position.
Figure 6:
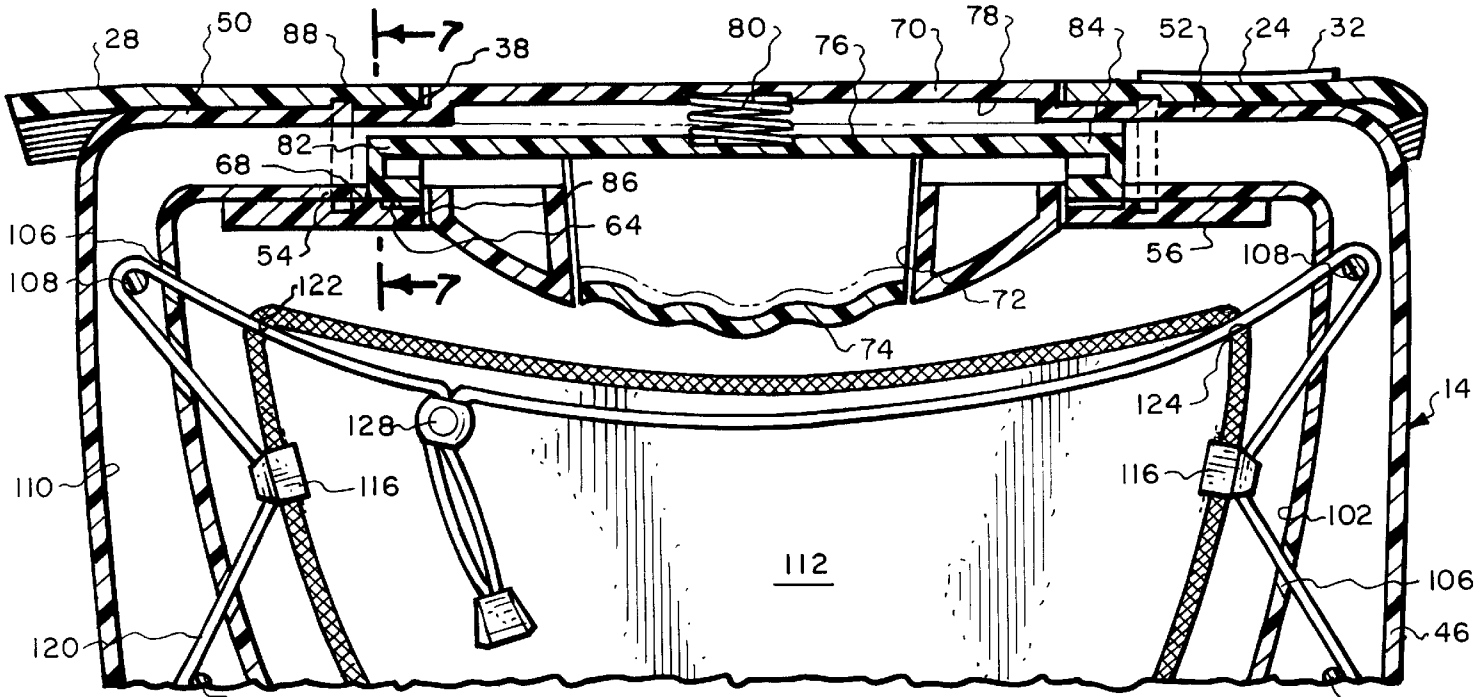
FIG. 6 is a cross-sectional view through one of the leg assemblies of the collapsible table of the present invention taken along line 6—6 of FIG. 1.
Figure 8:
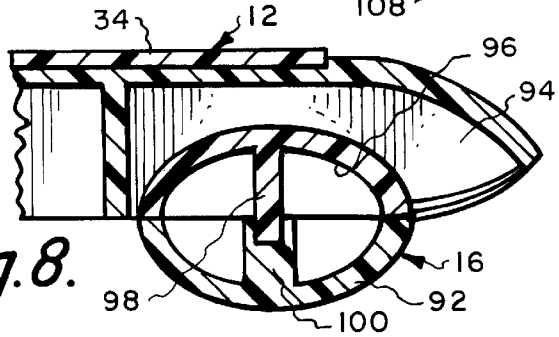
FIG. 8 is a cross-sectional view of the collapsible table of the present invention showing in greater detail the construction of the leg assembly taken along line 8—8 of FIG. 3.
Figure 7:
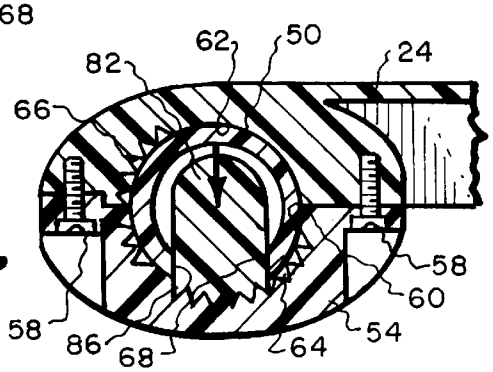
FIG. 7 is a cross-sectional view of the collapsible table of the present invention taken along line 7—7 of FIG. 6 showing the locking arrangement usable in conjunction with a leg assembly with the leg assembly in a specific position.

The main section 12 is comprised of two similarly sized parts 22 and 24. The parts 22 and 24 are hingedly connected together by hinge 26. The parts 22 and 24 can be located in an aligned position as shown in FIGS. 1–3 of the drawings with the parts 22 and 24 defining a planer work surface 28. It is to be understood that the parts 22 and 24 of the main section 12 will be constructed of a rigid plastic. Mounted on work surface 28 and located directly adjacent the forward edge 30 of the main section 12 are a pair of cushioning pads 32 and 34. A soft rubber or rubber and plastic composition would be satisfactory material of construction for the pads 32 and 34. Pad 32 is mounted on the part 24 with pad 34 being mounted on the part 22. For purposes of ornamentation, the pads 32 and 34 are shown to comprise somewhat of an acute triangular shape. However, it is to be within the scope of this invention that any particular type of shape could be utilized. The function of the pads is to provide a cushiony support for the wrist of a human when the wrists are resting on the pads 32 and 34. Typically, if a laptop computer were to be located on the work surface 28, the user's wrists would be located on the pads 32 and 34.

The part 22 includes a cutout 36 located at the right edge 20. In a similar manner, the part 24 includes a cutout 38 formed within the left edge 18. Formed within the part 22 adjacent the cutout 36 are four in number of holes 40. Similarly, there are four in number of holes 40 located within part 24 located directly adjacent the cutout 38. It is to be understood that the number of the holes 40 could be increased or decreased. The holes 40 are through holes. Each hole 40 includes a pair of diametrically spaced apart arcuate ribs 42. It is to be the function of the hole 40 to provide a way of mounting an exterior structure onto the main section 12. A typical exterior structure might be a small task light, page holder or cup holder. When a user desires to utilize one of the holes 40, the user is to unscrew plug 44 which is to be normally mounted in conjunction with each hole 40 with the upper surface of the plug 40 forming part of the work surface 28. It is the function of the plug 44 to close the hole 40 when the hole 40 is not being used.

The leg assembly 14 includes a leg member 46. The leg member 46 includes a base which has a concavely scalloped configuration 48 for purposes of ornamentation. The portion of the leg member 46 that is exterior to the scalloped configuration 48 will include rubber feet 91 shown in FIG. 2 to provide a non-slip connection with a hard supporting surface 134 on which the table 10 has been placed. The leg member 46 has ends 50 and 52 which are located in alignment and facing each other. End 50 is to be mounted to the part 24 by means of a cap 54. End 52 is mounted to the part 24 by means of a cap 56. The mounting of the cap 54 to the part 24 is accomplished by means of bolts 58. It is to be noted that the end 50 is located on one side of the cutout 38 with the end 52 being located at the opposite side of the cutout 38. Cap 54 includes a half cylinder shaped hole 60. The part 54 includes a similar half cylinder shaped hole 62. With the cap 54 mounted on the part 24, the holes 60 and 62 cooperate to form a single cylindrical shaped opening. It is to be noted that part of the surface of the hole 60 includes a series of gear teeth 64. Also, part of the surface of the hole 62 includes a series of gear teeth 66. The end 50 is mounted within the hole formed by holes 60 and 62 in a close conforming manner. Formed within the end 50 is an opening 68. The ends 50 and 52 are integrally connected together by means of crosspiece 70. Crosspiece 70 is located within the cutout 38. Crosspiece 70 has a center enlarged opening 72. Mounted within the center enlarged opening 72 is a handle 74. The handle 74 has a back member 76. The back member 76 is mounted within the internal chamber 78 of the crosspiece 70. Mounted between the back member 76 and the crosspiece 78 and located within internal chamber 78 is a coil spring 80.

One end of the back member 76 is formed into a knob 82. The opposite end of the back member 76 also includes a similar knob 84. The knob 82 includes a set of external gear teeth 86. The function of the coil spring 80 is to exert a continuous bias on the back member 76 tending to maintain engagement of the teeth 86 with the teeth 64 and/or 66. However, upon the handle member 64 being squeezed and moved compressing coil spring 80, the gear teeth 86 become disengaged from the gear teeth 64 and 66 and will permit the ends 50 and 52 of the leg member 46 to pivot relative to the main section 12. This pivoting is between the retracted position shown in FIG. 3 where the leg member 46 is located in abutting juxtaposition with the main section 12 to the extended position, shown in solid and dotted lines in FIG. 2, which will locate the leg member 46 substantially transverse to the main section 12. When the desired position is attained of the leg member 46, the handle member 74 is released which will cause the teeth 86, 64 and 66 to engage thereby fixing in position the leg member 46 relative to the main section 12. Pivoting of the end 50 relative to the part 24 is facilitated by means of bearing ring 88. Bearing ring 88 is mounted within an appropriate annular chamber formed between the part 24 and the cap 54.

It is to be understood that a similar structural arrangement will be utilized between knob 84, cap 56, part 24 and end 52. Located within the cutout 36 is a crosspiece 90 which is similar to crosspiece 70. Crosspiece 90 is integral with leg member 92 of the leg assembly 16. Leg member 92 is essentially identical to leg member 46.

Formed on the undersurface of both parts 22 and 24 are a series of strengthening ribs 94. These strengthening ribs 94 have a cavity 96 formed therein. The leg member 92 is actually formed of two parts which are interlocked together with center member 98 interlocking within post 100. This interlocking arrangement between the center member 98 and the post 100 keeps the leg member 92 in its established shape as well as leg member 46. The leg member 92 is to rest within the cavity 96 when the leg member is located in the retracted position shown in FIGS. 3–5.

Formed within the leg member 46 is an enlarged cutout 102. A similar enlarged cutout 104 is formed within the leg member 92. The wall of the enlarged cutout 102 includes a series of holes 106 with it being understood that there are a similar series of holes mounted within the leg member 92. Associated with each directly adjacent pair of holes 106 is a post 108 with it being understood that there are actually about six in number of the posts 108. The posts 108 are fixedly secured to the leg member 46 and also the leg member 92. The posts 108 are located within the hollow cavity 110 of the leg member 46, and of course also the leg member 92. An article containing bag 112 is to be located within the confines of the enlarged cutout 102 with a similar such bag 114 being located within the confines of the enlarged cutout 104. Mounted on the perimeter of the bag 112 are a plurality of spaced-apart brackets 116. Mounted on the periphery of the bag 114 are a similar series of brackets 118. A thin rope 120 is to be conducted through holes 122 and 124 formed within the bag 112. There is a similar thin rope 126 that is conducted through holes (not shown) that are located in conjunction with the bag 114. The thin rope 120 is then conducted through the holes 106 and is wound about the post 108 and then proceeds to connect to a bracket 116 and then conducted through another hole 106 and about a post 108, and so forth with the result that the bag 112 is fixedly mounted within the enlarged cutout 102. The thin rope 120 is to be tightened by the ends of the thin rope being pulled tight relative to ball fastener 128. The ends of the thin rope 120 and the ball fastener 128 are located within the interior of the bag 112. It is to be understood that the thin rope 120 is to be similarly threaded and connected around posts 108 which are mounted within the leg member 92 which will fixedly position the bag 114 within the enlarged cutout 104. The bag 112 includes a zipper 130 which is to be usable to gain access to the interior of the bag 112. There will be a similar zipper within the bag 114.

The bags 112 and 114 provide convenient storage pockets for useful space for frequently used devices and accessories.

Typical devices and accessories could comprise palm computers, CD players, cables and writing instruments.

Referring particularly to FIG. 2, it can be seen that the leg member 46 can be fixed in position along the vertical 132 which will locate the work surface 28 approximately eleven and one-half inches from the supporting surface 134. It is to be understood that the outer ends or tips of the leg assemblies 14 and 16 in the area of the scalloped configurations 48 will rest directly on the supporting surface 134. Supporting surface 134 could comprise a chair surface or other similar type of supporting surface. The leg member 46 could be fixed at an angle of approximately ten degrees or twenty degrees from the vertical 132 or also at a thirty degree angle from the vertical 132. At the thirty degree angle, that generally will be the maximum outer position for the leg member 46 which will locate the work surface 28 about ten inches from the supporting surface 134. The ten degree position of the leg member 46 will locate the work surface 28 approximately 11.5 inches from the supporting surface 134. The twenty degree outer deflection position of the leg member 46 will locate the work surface 28 at approximately 11.0 inches from the supporting surface 134. It is to be understood that these different height positions of the work surface 28 relative to the supporting surface 134 is to give adjustability of the collapsible table 10 relative to different sizes of human users. It is also to be within the scope of this invention that numerous other positions could be utilized if such is desired rather than the four positions that are shown in FIG. 2. It is also to be understood that the leg member 92 will be similarly adjustable, as was previously described in relation to leg member 46.

Figure 5:
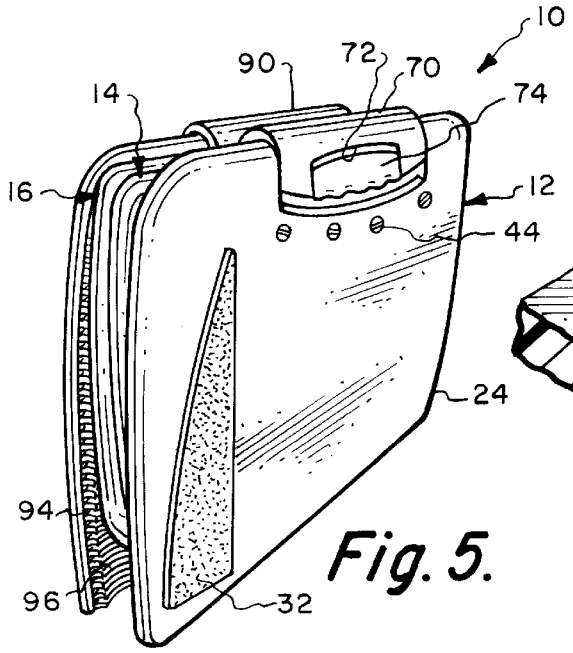
FIG. 5 is a front isometric view of the collapsible table of the present invention showing it in the completely collapsed position.
Figure 9:
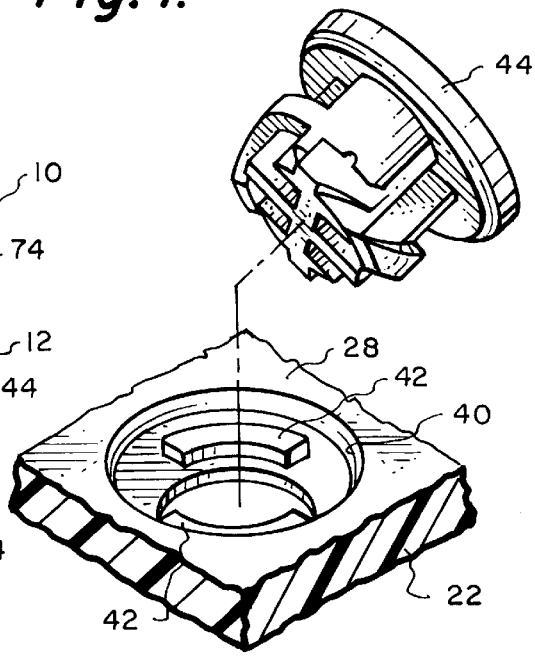
FIG. 9 is an isometric view of one of the mounting holes that are mounted in conjunction with the work surface of the collapsible table of the present invention showing the plug that is used to close the mounting hole being located in an exploded position with the plug being utilized when the hole is not being used.

When the collapsible table 10 is in the position shown in FIG. 1 and the user desires to collapse the table to the position shown in FIG. 5, it is necessary that the user depress each of the handles 74 which will permit the leg members 46 and 92 to be pivoted to the position shown in FIG. 3. The user can then fold the main section 12 with the parts 22 and 24 being moved into juxtaposition which will then locate the collapsible table 10 in the position shown in FIG. 5. The collapsible table 10 shown in FIG. 5 is then to be placed within a carry bag, which is not shown.

What is claimed is:

1. A collapsible table comprising:

a main section having a substantially planar work surface, said main section terminating in a right edge and a left edge;

a right leg assembly mounted on said right edge, a left leg assembly mounted on said left edge, said right leg assembly being similar to said left leg assembly, each said leg assembly including a leg member that is movable between a retracted position and an extended position, said retracted position locating a said leg member in juxtaposition with said main section, said extended position locating a said leg member substantially transverse to said main section, each said leg member being adjustable to a plurality of different height positions of said main section when said leg member is in said extended position, each said leg member being fixable in each of said height positions relative to said main section;

whereby said leg members are each to be movable to and fixed at a said height position with usage of said substantially planer work surface to then occur;

each said leg member including actuation means, operation of said actuation means permits a said leg member to be moved to said extended position and movable between said transverse positions; and said actuation means comprising a handle mounted in conjunction with each said leg member with there being a separate said handle for each said leg member, said handle being squeezable to permit movement of said leg assembly relative to said main section.

2. The collapsible table as defined in claim 1 wherein:

there being a locking arrangement located between each said leg member and said main section.

3. The collapsible table as defined in claim 1 including:

each said leg member including an enlarged cut-out, an article receiving bag being mounted within each said enlarged cut-out.

4. A collapsible table comprising:

a main section having a substantially planar work surface, said main section terminating in a right edge and a left edge;

a right leg assembly mounted on said right edge, a left leg assembly mounted on said left edge, said right leg assembly being similar to said left leg assembly, each said leg assembly including a leg member that is movable between a retracted position and an extended position, said retracted position locating a said leg member in juxtaposition with said main section, said extended position locating a said leg member in a transverse position of a plurality of transverse positions to said main section, each said leg member being adjustable to a plurality of said transverse positions, each said transverse Position locates said main section at a different height, each said leg member being fixable in each of said transverse positions relative to said main section;

whereby when said leg members are each moved to and fixed at a said transverse position usage of said substantially planer work surface is to then occur; and each said leg member including actuation means, operation of said actuation means permits a said leg member to be moved to said extended position and movable between said transverse positions, said actuation means comprising a handle mounted in conjunction with each said leg member with there being a separate said handle for each said leg member, said handle being squeezable to permit movement of said leg member relative to said main section.

5. The collapsible table as defined in claim 4 wherein:

there being a locking arrangement located between each said leg member and said main section.

* * * * *